US008528141B2

(12) United States Patent
Montabaur

(10) Patent No.: US 8,528,141 B2
(45) Date of Patent: Sep. 10, 2013

(54) DRESSING DEVICE FOR POWER BRUSH

(75) Inventor: Werner Montabaur, Königswinter (DE)

(73) Assignee: Monti-Werkzeuge GmbH, Bonn (DE)

( * ) Notice: Subject to any disclaimer, the term of this patent is extended or adjusted under 35 U.S.C. 154(b) by 2701 days.

(21) Appl. No.: 11/120,314

(22) Filed: Apr. 27, 2005

(65) Prior Publication Data

US 2005/0241085 A1 Nov. 3, 2005

(30) Foreign Application Priority Data

Apr. 29, 2004 (DE) ..... 10 2004 021 188

(51) Int. Cl.
*A46B 15/00* (2006.01)

(52) U.S. Cl.
USPC ..... 15/22.1; 15/23

(58) Field of Classification Search
USPC ..... 15/21.1, 22.1, 23, 28; 451/916
See application file for complete search history.

(56) References Cited

U.S. PATENT DOCUMENTS 1,627,704 A * 5/1927 Izawa ..... 451/541
3,314,410 A * 4/1967 Knauer et al. ..... 125/11.03
3,971,358 A * 7/1976 Sawluk ..... 125/11.03
4,151,684 A * 5/1979 Wada et al. ..... 451/21
4,235,218 A * 11/1980 Iida et al. ..... 125/11.03
4,475,321 A * 10/1984 Meyer ..... 451/56
4,492,061 A * 1/1985 Smith ..... 451/5
5,020,551 A * 6/1991 Guerret ..... 132/200
5,165,760 A * 11/1992 Gueret ..... 300/21
5,291,691 A * 3/1994 Unno et al. ..... 451/56
5,524,315 A 6/1996 Montabaur

FOREIGN PATENT DOCUMENTS

JP 334453 1/2004

* cited by examiner

*Primary Examiner* — Dung Van Nguyen
(74) *Attorney, Agent, or Firm* — Andrew Wilford

(57) ABSTRACT

A power-brush apparatus has a housing, a brush rotatable on the housing about a brush axis and having bristles extending generally radially of the axis, and a drive that rotates the brush in a working direction about the axis and thereby orbits tips of the bristles about the axis. Thus when in use the brush is rotated in this working direction. A support immediately adjacent the housing carries a rigid grinding wheel having an abrasive outer surface. This wheel is biased radially against the bristle tips to sharpen and clean them while a drive relatively displaces the bristle tips and the grinding-wheel surface while the wheel is urged against the bristle tips such that the grinding wheel surface primarily engages rear sides of the bristle tips turned away from the working direction.

10 Claims, 3 Drawing Sheets

DRESSING DEVICE FOR POWER BRUSH

FIELD OF THE INVENTION

The present invention relates to a brush. More particularly this invention concerns a brush which is rotatably driven.

BACKGROUND OF THE INVENTION

A standard power brush had an arbor that extends along an axis and that is rotated at high speed about the axis. A brush has a sleeve fitted to the arbor and a multiplicity of bristles that extend radially outward from the arbor.

In use the brush is rotated at high speed while outer ends or tips of the bristles are pressed against a workpiece so as to strip paint, descale, deflash, roughen, or otherwise surface treat the workpiece. The bristles can be made of natural or synthetic fibers, or of metal.

With time the outer ends of the bristles often bulk up or become quite blunt, in particular when working hard materials such as metal castings or stripping paint. There is frequently a buildup on the rear sides of the bristles, that is the sides facing rearward in the peripheral rotation direction. This thickening and buildup reduces the effectiveness of the power brush by imparting a blunt shape to the bristles with an outer end providing little abrasive or scraping action. Once such a brush gets clogged in this manner, it is normally so difficult to clean it that it is simply discarded and replaced.

OBJECTS OF THE INVENTION

It is therefore an object of the present invention to provide an improved power brush.

Another object is the provision of such an improved power brush that overcomes the above-given disadvantages, in particular whose effectiveness can be restored.

SUMMARY OF THE INVENTION

A power-brush apparatus has according to the invention a housing, a brush rotatable on the housing about a brush axis and having bristles extending generally radially of the axis, and a drive that rotates the brush in a working direction about the axis and thereby orbits tips of the bristles about the axis. Thus when in use the brush is rotated in this working direction. In accordance with the invention a support immediately adjacent the housing carries a rigid grinding wheel having an abrasive outer surface. This wheel is biased radially against the bristle tips to sharpen and clean them while a drive relatively displaces the bristle tips and the grinding-wheel surface while the wheel is urged against the bristle tips such that the grinding wheel surface primarily engages rear sides of the bristle tips turned away from the working direction.

Furthermore according to the invention the drive rotates the grinding wheel about a wheel axis in a rotation direction opposite the brush direction while the brush is rotating in the brush direction about the brush axis and displaces the outer surface of the wheel at a peripheral speed greater than a peripheral speed of the bristle tips. Alternately according to the invention, the stone can be stationary and the brush can be reverse rotated to grind the back sides of the bristle tips.

The stone axis according to the invention is substantially parallel to the brush axis. In addition the drive can rotate the stone about the stone axis in either of two opposite directions. Similarly the brush drive can rotate the brush about the brush axis in either of two directions, so that one way or another the back sides of the bristle tips are passed over the surface of the grinding stone.

The support according to the invention is mounted on the brush housing. Furthermore the support includes a base carried on the brush housing and an pivot interconnecting the base and the support for relative pivoting about a support axis. The support is provided with a handle projecting generally radially of the support axis.

A spring can be provided between the support and the base to press the stone radially against the brush. This ensures a constant pressure.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
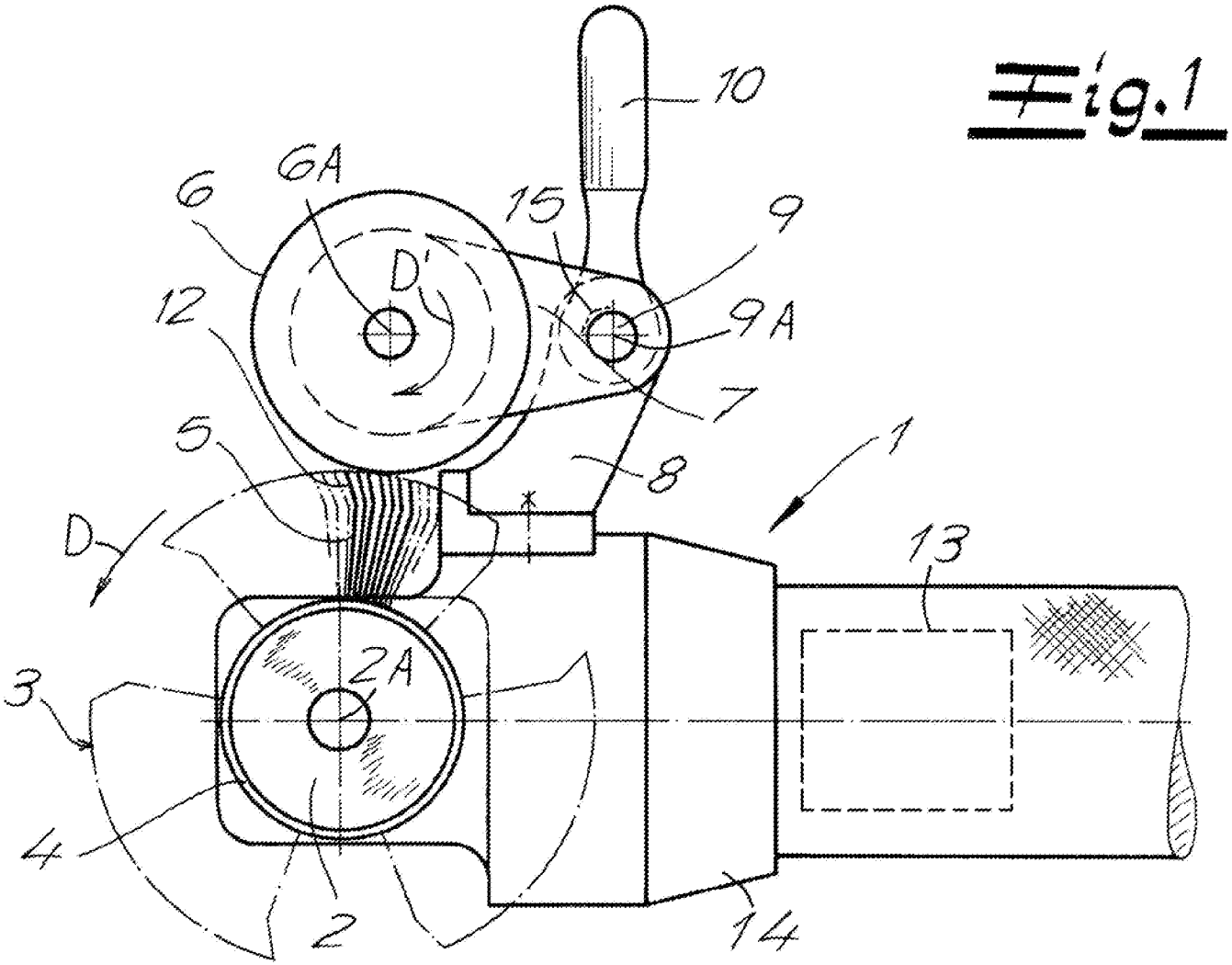
FIG. 1 is a side view of the power brush according to the invention.

As seen in FIG. 1 a power brush 1 according to the invention has a housing 14 on which is mounted a wire brush wheel 3. More particularly the brush 3 has a central sleeve 4 fitted snugly over a cylindrical arbor 2 rotatable about and centered on an axis 2A. Bristles 5 extend radially from the sleeve 4, and an electric or pneumatic motor 13 in the housing 14 normally rotates the arbor 2 and brush 3 about the axis 2A in the working direction D. The bristles 5 are normally pressed against a workpiece (not illustrated here) to remove corrosion, scale, flashing, or the like from its surfaces or to roughen it.

Figure 2:
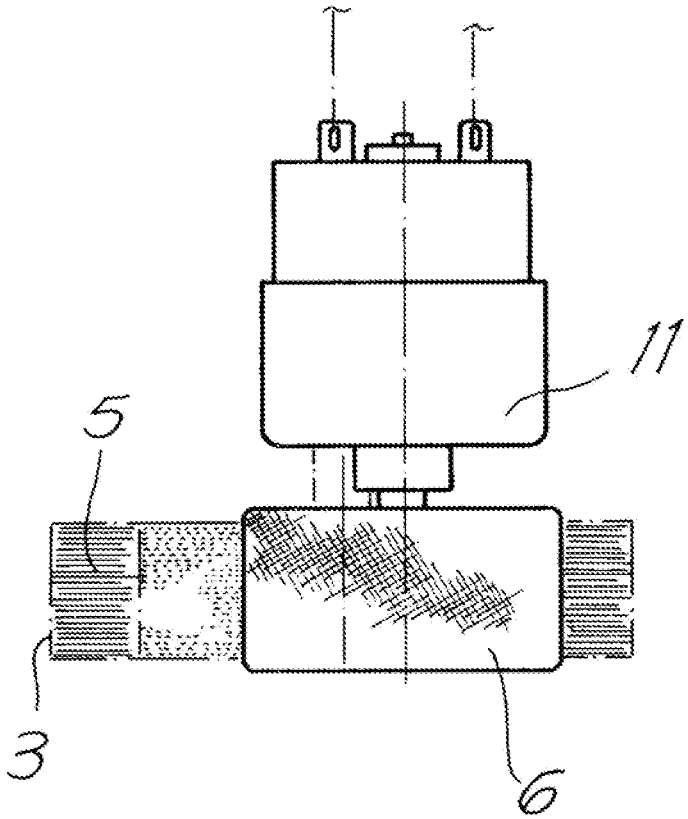
FIG. 2 is a top view of a detail of FIG. 1.
Figure 3:
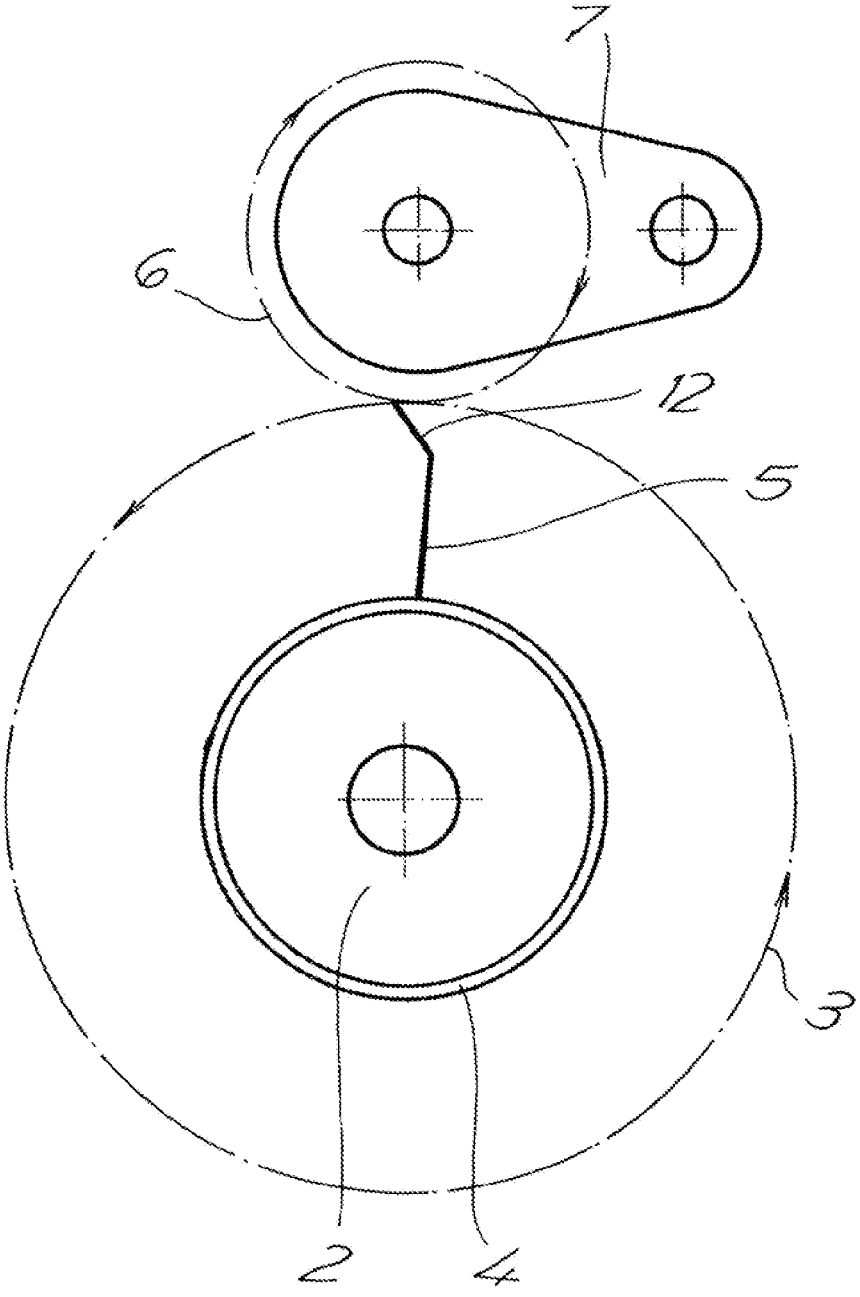
FIG. 3 is a schematic end view illustrating operation of the instant invention.

In accordance with the invention a cylindrical grinding wheel or stone 6 also shown in FIG. 2 is mounted on an arm 7 for rotation about an axis 6A by a motor 11. The arm 7 can in turn be pivoted on a shaft 9 having an axis 9A parallel to the axes 6A and 2A by a handle 10 to press the cylindrical outer surface of the stone 6 against forwardly tipped outer ends or tip 12 (FIG. 3) of the bristles 5. The arm 7 is carried on a support 8 here shown to be fixed to the housing 14 of the power brush 1. A torque spring shown partially schematically at 15 between the arm 7 and base 8 urges the stone 6 radially against the brush 3 with a predetermined constant force.

The wheel 6 here is a standard composition ceramic grinding stone formed as a cylindrical plinth. It could be some other rigid structure, for instance a drum with an abrasive surface, e.g. a sandpaper sleeve.

In the illustrated embodiment the drive motor 11 rotates the grinding stone 6 about the axis 6A in a stone direction D' opposite to the working direction D but at such a speed that the peripheral speed of the stone 6 is greater than that of the brush 3 so as to back sharpen the forwardly inclined bristle tips 12. This urges or bends these tips 12 somewhat forward 12 so that they are most effective in material removal. The stone 6 can be swung in and rotated for periodic sharpening, or can be left in place to continuously dress the bristles 5.

This restoration of the sharpened outer ends to the bristles 5 can be done periodically. Alternately, the drive motor 11 can run whenever the brush 3 is in use, with the stone 6 engaging the tips 12, so that the brush 3 is continuously refreshed and always has a like-new abrasiveness. In such a system the motor 11 can be dispensed with and replaced with some sort of transmission, e.g. a belt drive, that connects to the main drive motor 13 that rotates the brush 3.

The motor 11 is reversible so that, in a system where the peripheral speed of the stone 6 is equal to zero or less than that of the brush 3, the brush 3 can be reverse rotated to stroke the back sides of the tips 12 over the stone 6.

I claim:

1. A power-brush apparatus comprising:

a housing;

a brush rotatable on the housing about a brush axis and having bristles extending generally radially of the axis;

means for rotating the brush in a working direction about the axis and thereby orbiting tips of the bristles about the axis;

a support immediately adjacent the housing;

a rigid grinding wheel mounted on the support and having an abrasive outer surface;

biasing means for urging the wheel radially directly against the bristle tips; and drive means for rotating the grinding wheel about a wheel axis in a rotation direction opposite the brush direction while the brush is rotating in the brush direction about the brush axis and for displacing the outer surface of the wheel at a peripheral speed greater than a peripheral speed of the bristle tips while the wheel is urged against the bristle tips such that the grinding wheel surface primarily engages rear sides of the bristle tips turned away from the working direction.

2. The apparatus defined in claim 1 wherein the wheel axis is substantially parallel to the brush axis.

3. The apparatus defined in claim 1 wherein the drive means can rotate the wheel about the wheel axis in either of two opposite directions.

4. The apparatus defined in claim 1 wherein the support is mounted on the brush housing.

5. The apparatus defined in claim 4 wherein the support includes a base carried on the brush housing and a pivot interconnecting the base and the support for relative pivoting about a support axis.

6. The apparatus defined in claim 5 wherein the support is provided with a handle projecting generally radially of the support axis.

7. The apparatus defined in claim 5 wherein the biasing means includes a spring between the support and the base pressing the wheel radially against the brush.

8. The apparatus defined in claim 1 wherein the wheel is a composition ceramic grinding stone.

9. A power-brush apparatus comprising:

a housing;

a brush rotatable on the housing about a brush axis and having bristles extending generally radially of the axis;

means for rotating the brush in a working direction about the axis and thereby orbiting tips of the bristles about the axis;

a support pivoted on the housing;

a handle projecting from the support;

a rigid grinding wheel mounted on the support and having an abrasive outer surface;

biasing means for urging the wheel radially directly against the bristle tips; and drive means for rotating the grinding wheel about a wheel axis in a rotation direction opposite the brush direction while the brush is rotating in the brush direction about the brush axis and for displacing the outer surface of the wheel at a peripheral speed greater than a peripheral speed of the bristle tips while the wheel is urged against the bristle tips such that the grinding wheel surface primarily engages rear sides of the bristle tips turned away from the working direction, the bristle tips being tipped forward in the working direction.

10. A power-brush apparatus comprising:

a brush housing;

a brush rotatable on the housing about a brush axis and having bristles extending radially of the brush axis;

drive means for rotating the brush about the brush axis in a brush rotation direction and thereby orbiting tips of the bristles around the brush axis at a brush peripheral speed;

a support immediately adjacent the housing;

a grinding wheel having an abrasive outer surface and rotatable on the support about a wheel axis generally parallel to the brush axis;

means for urging the wheel radially directly against the bristle tips when the brush is rotating; and drive means for rotating the wheel about the wheel axis in a wheel rotation direction opposite the brush rotation direction and at a rotation rate moving the wheel surface at a wheel peripheral speed faster than the brush peripheral speed for grinding rear sides of the bristle tips.

* * * * *